US009982692B2

(12) United States Patent
Takahashi

(10) Patent No.: US 9,982,692 B2
(45) Date of Patent: May 29, 2018

(54) AIR CYLINDER APPARATUS EQUIPPED WITH FALL PREVENTION MECHANISM, AND FALL PREVENTION MECHANISM FOR AIR CYLINDER APPARATUS

(71) Applicant: Fujikura Rubber Ltd., Koto-ku, Tokyo (JP)

(72) Inventor: Masaki Takahashi, Saitama (JP)

(73) Assignee: FUJIKURA RUBBER LTD., Tokyo (JP)

( * ) Notice: Subject to any disclaimer, the term of this patent is extended or adjusted under 35 U.S.C. 154(b) by 428 days.

(21) Appl. No.: 14/436,129

(22) PCT Filed: Oct. 8, 2013

(86) PCT No.: PCT/JP2013/077302
§ 371 (c)(1),
(2) Date: Apr. 16, 2015

(87) PCT Pub. No.: WO2014/061499
PCT Pub. Date: Apr. 24, 2014

(65) Prior Publication Data

US 2015/0285279 A1 Oct. 8, 2015

(30) Foreign Application Priority Data

Oct. 18, 2012 (JP) ..... 2012-230403

(51) Int. Cl.
*F15B 15/26* (2006.01)
*F15B 15/14* (2006.01)

(52) U.S. Cl.
CPC ..... *F15B 15/262* (2013.01); *F15B 15/14* (2013.01); *F15B 2015/268* (2013.01)

(58) Field of Classification Search
CPC ..... F15B 15/262; F15B 2211/26; F15B 2211/72; B23K 11/317
See application file for complete search history.

(56) References Cited

U.S. PATENT DOCUMENTS 4,791,855 A * 12/1988 Matsui ..... F15B 15/262 188/67
4,969,390 A * 11/1990 Williams, III ..... B23Q 1/28 251/1.1

(Continued)

FOREIGN PATENT DOCUMENTS

CN 101523059 A 9/2009
DE 3719155 A1 * 12/1988 ..... F15B 15/262

(Continued)

OTHER PUBLICATIONS

International Search Report for PCT Application PCT/JP2013/077302 dated Oct. 28, 2013.

(Continued)

*Primary Examiner* — Michael Leslie
*Assistant Examiner* — Matthew Wiblin
(74) *Attorney, Agent, or Firm* — McCormick, Paulding & Huber LLP

(57) ABSTRACT

An air cylinder apparatus equipped with a fall prevention mechanism, wherein the air cylinder apparatus includes a cylinder body and a piston rod which advances and retreats by supplying and discharging pressurized air to and from the cylinder body, and wherein the fall prevention mechanism includes a fixed member which is immovable with respect to the cylinder body; a plurality of brake members which are supported by the fixed member to be capable of coming into and out of contact with the fixed member; a biasing member which presses the plurality of brake members against the piston rod to lock the piston rod to the fixed member; and a lock-release air mechanism which holds, against a biasing force of the biasing member, the brake members in a non-contact position with the piston rod, the lock-release air mechanism operating by a pressurized air source that is common with that of the air cylinder apparatus.

7 Claims, 3 Drawing Sheets

(56) References Cited

U.S. PATENT DOCUMENTS

| | | | | |
|---|---|---|---|---|
| 6,474,899 | B1 * | 11/2002 | Corradi | B23Q 1/28 188/67 |
| 8,387,515 | B2 | 3/2013 | Ikari et al. | |
| 2007/0199441 | A1 * | 8/2007 | Nakata | F15B 15/262 92/58 |

FOREIGN PATENT DOCUMENTS

| | | | | |
|---|---|---|---|---|
| DE | 3811968 | A1 * | 10/1989 | F15B 15/262 |
| DE | 19934750 | A1 * | 12/2000 | F15B 15/262 |
| EP | 1170511 | A2 * | 1/2002 | F15B 15/262 |
| EP | 1785633 | A2 * | 5/2007 | F15B 15/262 |
| FR | 1004826 | A * | 4/1952 | F15B 15/262 |
| JP | S47-11287 | B1 | 4/1972 | |
| JP | S55155903 | A | 4/1980 | |
| JP | S57-73403 | | 5/1982 | |
| JP | S63-20503 | | 2/1988 | |
| JP | S63-141303 | | 9/1988 | |
| JP | 02-021001 | A | 1/1990 | |
| JP | H03-10077 | | 1/1991 | |
| JP | H05-75503 | | 10/1993 | |
| JP | 09-105431 | A | 4/1997 | |
| JP | 2005-133878 | A | 5/2005 | |
| JP | 2006266885 | A | 5/2006 | |
| JP | 2006-266885 | A | 10/2006 | |
| JP | 2007-309504 | A | 11/2007 | |

OTHER PUBLICATIONS

Japanese Official Action dated Apr. 19, 2016 corresponding to the above-identified case.

Taiwanese Office Action dated Oct. 20, 2016 for corresponding Taiwanese Application No. 102127231.

* cited by examiner

AIR CYLINDER APPARATUS EQUIPPED WITH FALL PREVENTION MECHANISM, AND FALL PREVENTION MECHANISM FOR AIR CYLINDER APPARATUS

CROSS-REFERENCE TO RELATED APPLICATION

This application is entitled to the benefit of and incorporates by reference subject matter disclosed in International Patent Application No. PCT/JP2013/077302 filed on Oct. 8, 2013 and Japanese Patent Application 2012-230403 filed Oct. 18, 2012.

TECHNICAL FIELD

The present invention relates to an air cylinder apparatus equipped with a fall prevention mechanism.

BACKGROUND OF THE INVENTION

Air cylinder apparatuses are used as a power source for various devices. Among them, in an air cylinder apparatus such as a depositor, a bonder or a precision polishing machine that is used in a manner to move a workpiece up and down by a piston rod that is slidably fitted into a cylinder body, an apparatus which locks the piston rod to the cylinder body at an ascending position (specific position) of the piston rod so that the workpiece does not fall upon an occurrence of an air leakage, an air shortage, or the like, in the air cylinder apparatus has been proposed. See Japanese Unexamined Utility Model Publication No. H05-75503.

Technical Problem

However, conventional fall prevention (safety) mechanisms are provided between the cylinder body and the piston rod in advance, thus being difficult to be applied to an air cylinder apparatus, once the air cylinder apparatus has been installed. In other words, the conventional fall prevention mechanism cannot be made to function for an air cylinder apparatus that has been installed unless modifications are made to the cylinder body and the piston rod.

Based on the awareness of the above described issues, an object of the present invention is to obtain an air cylinder apparatus equipped with a fall prevention apparatus which can prevent the piston rod from falling, without modifying the cylinder body or the piston rod of the air cylinder apparatus themselves, upon occurrence of a malfunction in the pressurized air supply system.

SUMMARY OF INVENTION

Solution to Problem

The present invention is characterized by an air cylinder apparatus equipped with a fall prevention mechanism, the air cylinder apparatus including a cylinder body and a piston rod which advances and retreats by supplying and discharging pressurized air to and from the cylinder body, wherein the fall prevention mechanism includes a fixed member which is immovable with respect to the cylinder body; a plurality of brake members which are supported by the fixed member to be capable of coming into and out of contact with the fixed member; a biasing member which presses the plurality of brake members against the piston rod to lock the piston rod to the fixed member; and a lock-release air mechanism which holds, against a biasing force of the biasing member, the brake members in a non-contact position with the piston rod, the lock-release air mechanism operating by a pressurized air source that is common with that of the air cylinder apparatus.

The fixed member can be shaped into a frame which surrounds an outer periphery of the piston rod.

The frame-shaped fixed member can include a pair of brake member support bars which face each other and support the brake members, and a pair of air-mechanism support bars which face each other and are orthogonal to the pair of brake member support bars, the pair of air-mechanism support bars including the lock-release air mechanism.

It is practical for the lock-release air mechanism to include an output member which is engaged with and disengaged from the brake members, and a pressure chamber which holds the output member in a disengaged position from the piston rod by engagement with the brake members. The pressure chamber is connected to the pressurized air source that is common with that of the air cylinder apparatus.

It is desirable for a power-assisted mechanism, which reduces and transfers an amount of movement of the output member to the brake members, to be interposed between the output member and the brake members.

For example, the power-assisted mechanism can include the output member which is supported to be capable of moving in a direction that intersects an advancing/retreating direction of the brake members, pressing surfaces which are formed on the brake members to be inclined to an advancing/retreating direction of the output member, and force applying portions which are formed on the output member and engaged with the pressing surfaces.

In addition, the present invention is characterized by an air cylinder apparatus, equipped with a fall prevention mechanism, including a frame member; a plurality of brake members which are supported by the frame member to be movable toward a center of the frame member; a biasing member which biases and moves the brake members in a direction toward the center of the frame member; and a lock-release air mechanism which operates by a pressurized air source to move the brake members in a direction away from the center of the frame member.

Advantageous Effects of Invention

According to the present invention, a fall prevention apparatus is achieved which can prevent the piston rod of an air cylinder apparatus from falling, without modifying the cylinder body or the piston rod themselves, upon occurrence of a malfunction in the pressurized air supply system. Accordingly, a useful fall prevention apparatus which can also be relatively easily installed, by a "retrofit", onto an already-existing air cylinder apparatus.

DESCRIPTION OF THE PREFERRED EMBODIMENTS

Figure 1:
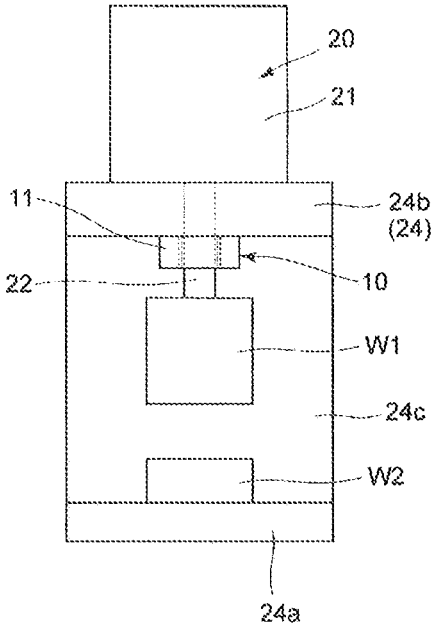
FIG. 1 is a front elevational view of an air cylinder apparatus equipped with a fall prevention apparatus according to the present invention, showing an example of the outward appearance thereof.
Figure 2:
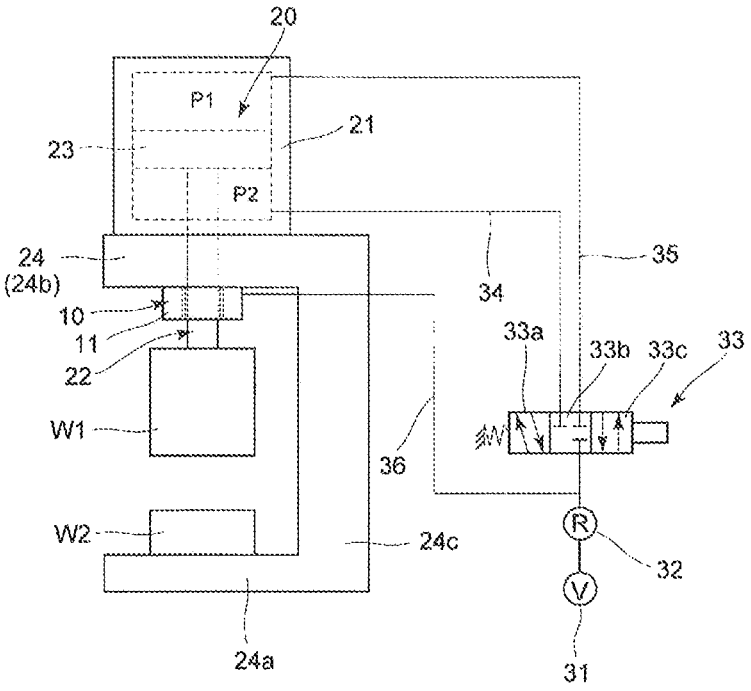
FIG. 2 is a side elevational view of the same.
Figure 3:
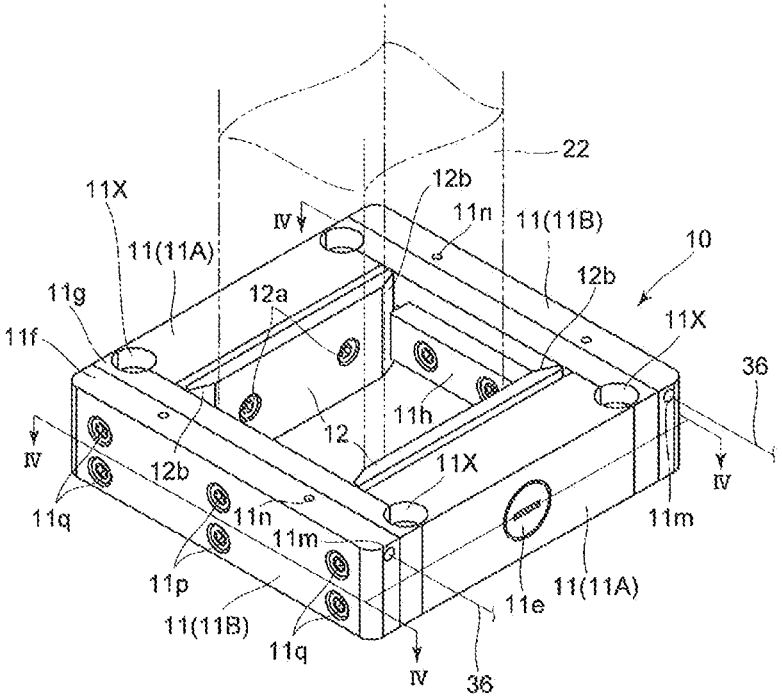
FIG. 3 is a perspective view of only the fall prevention apparatus, according to the present invention.
Figure 4:
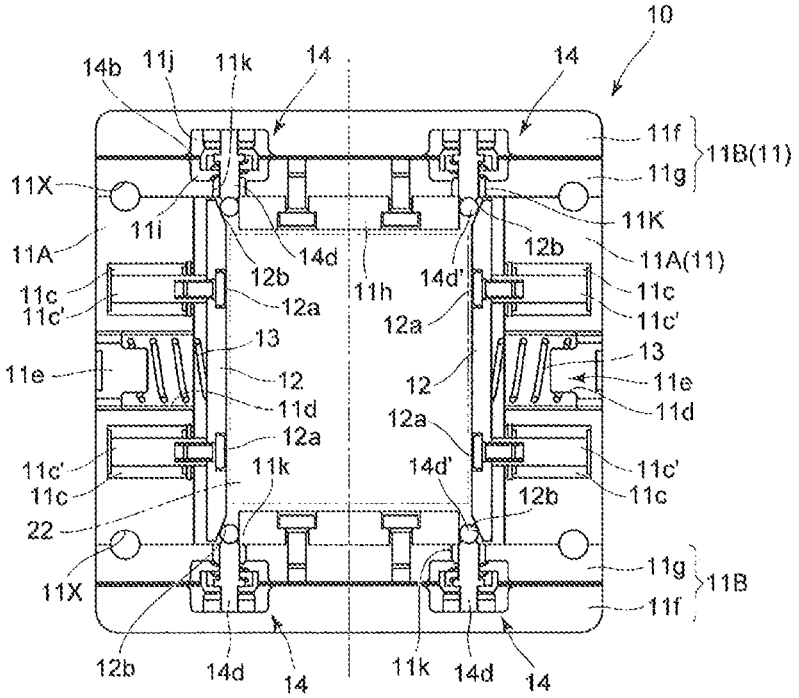
FIG. 4 is a sectional view taken along the line IV-IV line (plane) shown in FIG. 3.
Figure 5:
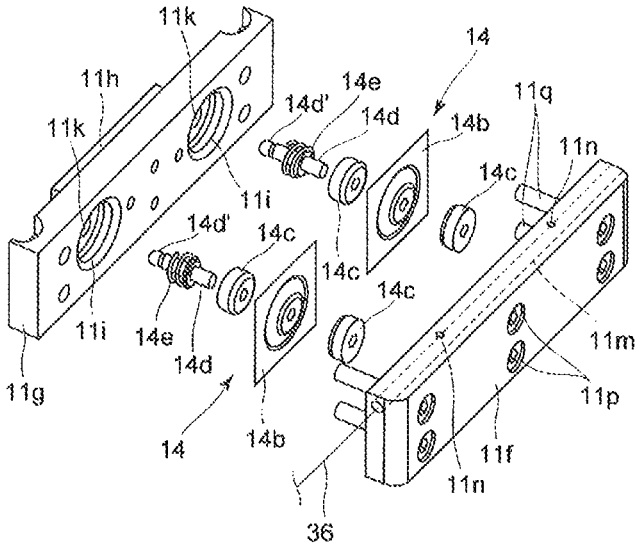
FIG. 5 is an exploded perspective view of a pair of mutually opposed air-mechanism support bars of a rectangular frame member of the fall prevention apparatus shown in FIG. 3.
Figure 6:
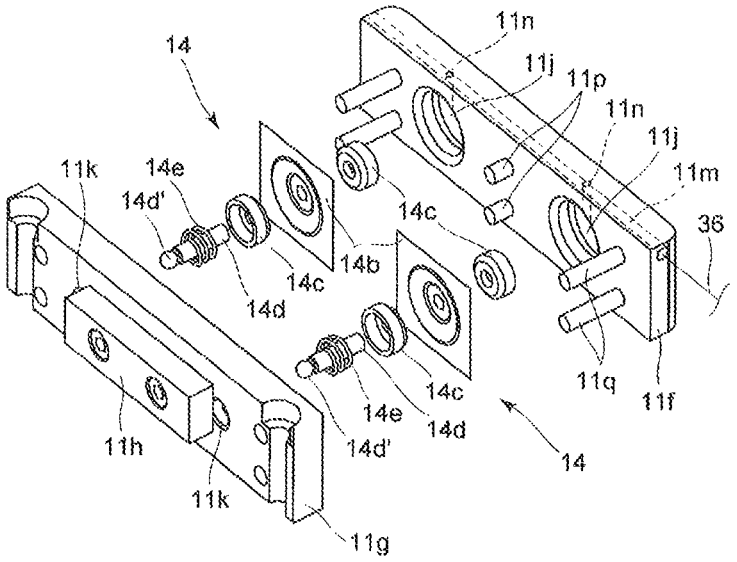
FIG. 6 is an exploded perspective view of the pair of mutually opposed air-mechanism support bars, viewed from the opposite direction.

FIGS. 1 and 2 show an example of the outward appearance of an air cylinder apparatus 20 equipped with a fall prevention mechanism 10 according to the present invention. The air cylinder apparatus 20 is provided with an air cylinder body 21, the axis of which extends in the vertical direction, and a piston rod 22 which is supported by the air cylinder body 21 to be movable up and down. As schematically shown, the piston rod 22 is coupled to a piston 23 which is slidably fitted into the air cylinder body 21, and pressurized air is selectively (alternatively) supplied and exhausted to and from cylinder pressure chambers P1 and P2, which are partitioned as upper and lower partitions by the piston 23 (and a sealing member or a rolling diaphragm), via a compressed air source 31, a regulator 32, a switching valve 33 and air flow channels 34 and 35.

A support base 24 which supports the air cylinder apparatus 20 is in the shape of a letter U and is provided with a bottom wall 24*a*, an upper wall 24*b* and a connecting wall 24*c*. The air cylinder body 21 is fixed to the upper wall 24*b*, and the piston rod 22 extends downward from the upper wall 24*b*. A movable work-tool W1 is mounted to the lower end of the piston rod 22, and some work is performed between the movable work-tool W1 and a fixed work-tool W2, mounted on the bottom wall 24*a*, by moving the movable work-tool W1 up and down with the piston rod 22.

The fall prevention mechanism 10 is for preventing the piston rod 22 from falling from the air cylinder body 21 (the upper wall 24*b*) when the supply of pressurized air to the air cylinder 20 stops due to some reason; the fall prevention mechanism 10 is fixed to the lower surface of the upper wall 24*b*. FIGS. 3 through 6 show an embodiment of the fall prevention mechanism 10. The fall prevention mechanism 10 is provided with a frame member (fixed member) 11 which is fixed to the upper wall 24*b* with the piston rod 22 inserted through the frame member 11, brake members 12 which are movable relative to the frame member 11 and come into and out of contact with the piston rod 22, compression coil springs (biaser) 13 which bias the brake members 12 toward the piston rod 22, and lock-release air mechanisms 14 which hold the brake members 12 at a disengaged position (unlocked position) from the piston rod 22 against the biasing forces of the compression coil springs 13.

The piston rod 22 in this embodiment is rectangular in a cross section, and the frame member 11 is in the shape of a rectangle which surrounds the piston rod 22 to correspond to the rectangular cross sectional shape of the piston rod 22. Two opposite sides of the rectangular frame member 11 and the other two opposite sides of the rectangular frame member 11 that are orthogonal to the aforementioned opposite sides are formed as a pair of brake member support bars 11A and a pair of air-mechanism support bars 11B, respectively.

The pair of brake member support bars 11A are mutually identical in structure. Linear ball bearings 11*c* which are orthogonal to the lengthwise direction of the brake member support bars 11A are embedded in the brake member support bars 11A, and the brake members 12 are fixed to linear members 11*c*' of the linear ball bearings 11*c* by set screws 12*a*. In addition, a spring support hole 11*d* is bored in each brake member support bar 11A to be positioned between the pair of linear ball bearings 11*c* thereof, and the compression coil springs 13 that are inserted into the spring support holes 11*d* are supported between spring adjust screws 11*e* which are screw-engaged in the spring support holes 11*d* and the brake members 12.

The pair of air-mechanism support bars 11B are also mutually identical in structure and are each provided with a pair of split boards 11*f* and 11*g* and a stopper plate 11*h* which is fixed by screws to the split board 11*g* that is positioned on the inner side. The stopper plates 11*h* restrict the jutting ends of the brake members 12 that jut due to the compression coil springs 13. The pair of brake members 12 come in contact with the piston rod 22 at positions before the pair of brakes members 12 come in contact with the stopper plates 11*h* to fix the piston rod 22 to the fall prevention mechanism 10. The forces of the compression coil springs 13 have been set large enough to prevent the piston rod 22 from falling.

Two lock-release air mechanisms 14 are supported between one pair of split boards 11*f* and 11*g* of each air mechanism support bar 11B so that two pairs of lock-release air mechanisms 14 operate to act on both ends of the brake members 12, respectively. Each lock-release air mechanism 14 is provided with a diaphragm 14*b* which is sandwiched between the pair of split boards 11*f* and 11*g*, an output rod (output member) 14*d* which is coupled to the diaphragm 14*b* via a joining member 14*c*, and a compression spring 14*e* which biases and moves the output rod 14*d* toward the brake member 12; each lock-release air mechanism 14 is provided with an air discharging chamber 11*i* and a pressure chamber 11*j* which are partitioned by the diaphragm 14*b* and formed in the associated pair of split boards 11*f* and 11*g*.

The output rods 14*d* project into the inside of the frame member 11 through through-holes 11*k* formed in the split boards 11*g*, and spherical force applying portions (force applying portions) 14*d*' are formed at the ends of the output rods 14*d*. The brake members 12 are provided with pressing surfaces 12*b* which are formed to be inclined to the advancing/retreating direction of the output rods 14*d* and with which the spherical force applying portions 14*d*' come in contact, and movements of the output rods 14*d* in directions toward the brake members 12 (the pressing surfaces 12*b*) against the forces of the compression coil springs 13 cause the brake members 12 to retreat. The inclined surfaces of the pressing surfaces 12*b* constitute a power-assisted mechanism which moves the brake members 12 in directions orthogonal to the output rods 14*d* by an amount of movement that is smaller (e.g., 0.2 through 0.5) than a unit amount of movement (1) of the output rods 14*d* when the output rods 14*d* move by this unit amount of movement. With this power-assisted mechanism, the pressure of the pressurized air supplied to the pressure chambers 11*j* can be boosted and transferred to the brake members 12.

Air supply holes 11*m* and 11*n* which are communicatively connected to the pressure chambers 11*j* are formed in the split boards 11*f*, and the air supply holes 11*m* are connected to the compressed air source 31 via an air flow channel 36 between the regulator 32 and the switching valve 33. The air supply holes 11*m* and 11*n* are formed as through-holes, and ends (one end of each) thereof are closed by closing members.

The output rods 14*d* jut in the direction toward the brake members 12 against the forces of the compression springs 14*e* and press the pressing surfaces 12*b* via the spherical force applying portions 14*d*' to make the brake members 12 retreat in a state where pressurized air of the compressed air source 31 is supplied to the pressure chambers 11*j* via the air flow channel 36 and the air supply holes 11*m* and 11*n*. In other words, the output rods 14*d* are each held in a non-contact position with the associated brake member 12. In a state where the supply of pressurized air to the pressure chambers 11*j* is stopped, the compression springs 14*e* make the output rods 14*d* retreat to positions at which the output rods 14*d* are in non-contact with the brake members 12.

The split boards 11*f* and 11*g* are fixed to each other via set screws 11*p*, and the split boards 11*f* and 11*g* (the air-mechanism support bars 11B) thus fixed are fixed to the brake member support bars 11A via set screws 11*q* to complete the rectangular frame member 11. The frame member 11 is fixed to the lower surface of the upper wall 24*b* of the support base 24 via bolt insertion holes 11X (FIGS. 3 and 4) which are formed between the brake member support bars 11A and the air-mechanism support bars 11B.

The present apparatus that has the above described structure operates in a manner which will be discussed hereinafter. In a state where the compressed air source 31 and the regulator 32 supply pressurized air at a normal pressure, this pressurized air is supplied to the pressure chamber 11*j* of each lock-release air mechanism 14 via the air flow channel 36 and the air supply holes 11*m* and 11*n*. As described above, one pair of lock-release air mechanisms 14 is provided for each brake member 12, and the pressurized air supplied to each pressure chamber 11*j* causes the spherical force applying portions 14*d*' to act on the pressing surfaces 12*b* at both ends of each brake member 12 to hold the output rods 14*d* in positions (non-contact positions with the piston rod 22) to retract the brake members 12 against the forces of the compression coil springs 13. Accordingly, without influencing the operation of the air cylinder apparatus 20, pressurized air can be selectively supplied to the cylinder pressure chambers P1 and P2 to freely move the piston rod 22 (the movable work-tool W1) upward or downward or to stop moving the piston rod 22 by selectively connecting ports 33*a*, 33*b* and 33*c* of the switching valve 33 to the air flow channels 34 and 35.

Whereas, if the pressurized air from the compressed air source 31 and the regulator 32 stops (the pressure drops below a normal value) for some reason, the pressure of the air supplied to the pressure chamber 11*j* from the air supply holes 11*m* and 11*n* likewise drops. Thereupon, the force which holds the brake members 12 in a non-contact position with the piston rod 22 disappears, which causes the pair of brake members 12 to clamp the piston rod 22 with the compression coil springs 13 to prevent the piston rod 22 (the movable work-tool W1) from falling. The output rods 14*d* retreat by the forces of the compression springs 14*e*. Accordingly, an accident, which may occur by the movable work-tool W1 falling onto the fixed work-tool W2, can be prevented from occurring.

Although the brake members 12, which come into and out of contact with the piston rod 22, are provided as a pair and are supported by the rectangular frame member 11 in the above illustrated embodiment, it is possible to increase the number of the brake members 12; in addition, the fixed member which supports the brake members 12 does not have to be shaped into a frame. Additionally, the present invention is applicable regardless of the specific structure of the air cylinder apparatus 20, how the air cylinder apparatus 20 is supported, or the shape of the movable work-tool W1. The present embodiment of the fall prevention mechanism 10 is useful for the application thereof to the pre-existing air cylinder apparatus 20 by a "retrofit".

INDUSTRIAL APPLICABILITY

An air cylinder apparatus equipped with a fall prevention mechanism according to the present invention can also be relatively easily installed, by a "retrofit", to an already-existing air cylinder apparatus and can be widely used as a low-cost fall prevention mechanism.

Although various embodiments of the present invention have been described and shown, the invention is not restricted thereto, but may also be embodied in other ways within the scope of the subject-matter defined in the following claims.

REFERENCE NUMERAL LIST

10 Fall prevention mechanism
11 Frame member (Fixed member)
11A Brake member support bar
11B Air-mechanism support bar
11*c* Linear ball bearing
11*c*' Linear member
11*d* Spring support hole
11*e* Spring adjustment screw
11*f* 11*g* Split board
11*h* Stopper plate
11*i* Air discharge chamber
11*j* Pressure chamber
11*k* Through-hole
11*m* 11*n* Air supply hole
12 Brake member
12*a* Set screw
12*b* Pressed surface
13 Compression coil spring (Biasing member)
14 Lock-release air mechanism
14*b* Diaphragm
14*c* Joining member
14*d* Output rod (Output member)
14*d*' Spherical force supplying portion
14*e* Compression spring
20 Air cylinder apparatus
21 Air cylinder body
22 Piston rod
23 Piston
P1 P2 Cylindrical pressure chamber
24 Support base
24*a* Bottom wall
24*b* Upper wall
24*c* Connecting wall
31 Compressed air source
32 Regulator
33 Switching valve
34 35 36 air flow channel

What is claimed is:

1. An air cylinder apparatus equipped with a fall prevention mechanism, said air cylinder apparatus including a cylinder body and a piston rod which advances and retreats by supplying and discharging pressurized air to and from said cylinder body, wherein said fall prevention mechanism comprises:

a fixed member which is immovable with respect to said cylinder body;

a plurality of brake members which are supported by said fixed member to be capable of coming into and out of contact with said piston rod;

a biasing member which presses said plurality of brake members against said piston rod to lock said piston rod to said fixed member;

a lock-release air mechanism which holds, against a biasing force of said biasing member, said brake members in a non-contact position with said piston rod, said lock-release air mechanism operating by a pressurized air source that is common with that of said air cylinder apparatus, and said lock-release air mechanism comprising an output member which engages with and disengages from said brake members, said output member being supported for movement in a direction that intersects an advancing/retreating direction of said brake members; and a power-assisted mechanism formed by said output member and said brake members, which reduces an amount of movement of said output member transferred to said brake members, wherein said power-assisted mechanism comprises:

pressing surfaces which are formed on said brake members to be inclined to an advancing/retreating direction of said output member so as to allow a reduced amount of movement of the brake member in comparison to the amount of movement of the output member; and force applying portions which are formed on said output member and engaged with said pressing surfaces.

2. The air cylinder apparatus equipped with said fall prevention mechanism according to claim 1, wherein said fixed member is shaped into a frame which surrounds an outer periphery of said piston rod.

3. The air cylinder apparatus equipped with said fall prevention mechanism according to claim 2, wherein the frame-shaped fixed member comprises:

a pair of brake member support bars which face each other and support said brake members; and a pair of air-mechanism support bars which face each other and are orthogonal to said pair of brake member support bars, said pair of air-mechanism support bars including said lock-release air mechanism.

4. The air cylinder apparatus equipped with said fall prevention mechanism according to claim 3, wherein said lock-release air mechanism comprises:

a pressure chamber which holds said output member in a disengaged position from said piston rod by engagement with said brake members, wherein said pressure chamber is connected to said pressurized air source that is common with that of said air cylinder apparatus.

5. The air cylinder apparatus equipped with said fall prevention mechanism according to claim 2, wherein said lock-release air mechanism comprises:

a pressure chamber which holds said output member in a disengaged position from said piston rod by engagement with said brake members, wherein said pressure chamber is connected to said pressurized air source that is common with that of said air cylinder apparatus.

6. The air cylinder apparatus equipped with said fall prevention mechanism according to claim 1, wherein said lock-release air mechanism comprises:

a pressure chamber which holds said output member in a disengaged position from said piston rod by engagement with said brake members, wherein said pressure chamber is connected to said pressurized air source that is common with that of said air cylinder apparatus.

7. An air cylinder apparatus, equipped with a fall prevention mechanism, comprising:

a frame member;

a plurality of brake members which are supported by said frame member to be movable toward a center of said frame member;

a biasing member which biases and moves said brake members in a direction toward said center of said frame member;

a lock-release air mechanism which operates by a pressurized air source to move said brake members in a direction away from said center of said frame member, said lock-release air mechanism comprising an output member which engages with and disengages from said brake members, said output member being supported for movement in a direction that intersects an advancing/retreating direction of said brake members; and a power-assisted mechanism formed by said output member and said brake members, which reduces an amount of movement of said output member transferred to said brake members, wherein said power-assisted mechanism comprises:

pressing surfaces which are formed on said brake members to be inclined to an advancing/retreating direction of said output member so as to allow a reduced amount of movement of the brake member in comparison to the amount of movement of the output member; and force applying portions which are formed on said output member and engaged with said pressing surfaces.

* * * * *